US006773150B2

(12) United States Patent
Giordani et al.

(10) Patent No.: US 6,773,150 B2
(45) Date of Patent: Aug. 10, 2004

(54) LIGHTING DEVICE FOR A VEHICLE

(75) Inventors: Marc Giordani, LaRuelle (CH); Christian Lietar, Morges (CH)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/350,682

(22) Filed: Jan. 24, 2003

(65) Prior Publication Data

US 2003/0112629 A1 Jun. 19, 2003

Related U.S. Application Data

(63) Continuation of application No. 08/919,038, filed on Aug. 27, 1997, now abandoned.

(30) Foreign Application Priority Data

Aug. 28, 1996 (DE) ..... 196 34 755

(51) Int. Cl.[7] ..... F21W 101/10
(52) U.S. Cl. ..... 362/518; 362/348
(58) Field of Search ..... 362/518, 297, 362/346, 347, 348, 350

(56) References Cited

U.S. PATENT DOCUMENTS 5,416,671 A 5/1995 Uchida ..... 362/61
6,000,816 A * 12/1999 Serizawa et al. ..... 362/297
6,004,014 A * 12/1999 Yamamura et al. ..... 362/518
6,062,714 A * 5/2000 Serizawa et al. ..... 362/518
6,402,355 B1 * 6/2002 Kinouchi ..... 362/514
6,422,726 B1 * 7/2002 Tatsukawa et al. ..... 362/517

FOREIGN PATENT DOCUMENTS

| | | |
|---|---|---|
| DE | 622 156 C | 11/1935 |
| EP | 0 355 815 A | 2/1990 |
| EP | 0 581 661 A | 2/1994 |

* cited by examiner

*Primary Examiner*—Laura K. Tso
(74) *Attorney, Agent, or Firm*—Michael J. Striker

(57) ABSTRACT

The lighting device includes a light source (12) and a reflector (10), which is provided with a reflecting surface (16) with a basic shape formed so that light generated by the light source (12) is reflected from the reflecting surface (16) as a light beam with a predetermined characteristic. The reflecting surface is provided with a wave structure superimposed on the basic form and including alternating successive scattering wave sections (32; 42) and concentrating wave sections (34; 44). The extent (b) of the scattering wave section (32) perpendicular to the surface lines (33) is substantially larger than the extent (c) of the concentrating wave sections (34) perpendicular to the surface lines (35). Because of the wave structure the light beam reflected by the reflecting surface is scattered and made uniform.

5 Claims, 3 Drawing Sheets

LIGHTING DEVICE FOR A VEHICLE

This application is a continuation of 08/919,038 filed Aug. 27, 1997 now abandoned.

BACKGROUND OF THE INVENTION

The present invention relates to a lighting device for a vehicle, and, more particularly, to a lighting device comprising a light source and a reflector which has a reflecting surface with a basic shape which is designed so that light generated by the light source is reflected from it as a light beam and which has an undulating or wave-like structure with alternating successive scattering wave sections and concentrating wave sections superimposed on its basic shape, by which the light beam reflected by the reflecting surface is made uniform.

This type of lighting device is described in European Patent Document EP 0 581 661 A. This lighting device has a light source and a reflector. The reflector has a reflecting surface whose basic shape is formed or designed so that light issuing from the light source is reflected as a light beam with predetermined characteristics. In order to make the intensity distribution produced by the light beam uniform, which means to avoid regions with undesirably strong or weak illumination, a wave structure with successive scattering and concentrating wave sections is superimposed on the reflecting surface of the reflector. This wave structure should be determined by random variations in the basic form of the reflecting surface. In this reference nothing is stated regarding the size of the scattering and concentrating wave sections, although this is of essential significance for the desired uniformity of the light beam and in which regions with undesirably high light intensity can be provided through the concentrating wave sections. A sufficiently uniform reflected light beam cannot be attained under the circumstances with the known lighting device. Wave sections are superposed on the reflecting surface in horizontal longitudinal cross-section and also in vertical longitudinal cross-section. A deflection of the light beam in both the horizontal and vertical directions is thereby caused relative to the light beam that would be reflected by a surface with only the smooth basic shape of the reflecting surface, so that particularly with dimmed headlights, such as low-beam headlights or fog lights, a deflection of the light beam in a vertical direction over the light-dark boundary is not desired and/or permitted. The known lighting device of the above-described type is thus not suitable for use as a dimmed or low-beam headlight.

SUMMARY OF THE INVENTION

It is an object of the invention to provide a lighting device for a vehicle of the above-described type which does not have the above-described disadvantages.

This object, and others which will be made more apparent hereinafter, is attained in a lighting device comprising a light source and a reflector which has a reflecting surface with a basic shape which is designed so that light generated by the light source is reflected from it as a light beam and which has an undulating or wave-like structure with alternating successive scattering wave sections and concentrating wave sections superimposed on its basic shape, by which the light beam reflected by the reflecting surface is made uniform.

According to the invention the extent of the scattering wave sections perpendicular to their surface lines is substantially larger than the extent of the concentrating wave sections perpendicular to their surface lines.

The lighting device according the invention has the advantage that regions with undesirably greater illumination intensity can be avoided by the stated larger extent of the scattering wave sections relative to the concentrating wave sections so that a sufficiently uniform reflected light beam can be obtained.

Advantageous embodiments and features of the invention are claimed and described in the appended dependent claims. For example in a preferred embodiment of the lighting device the scattering wave sections and the concentrating wave sections are arranged so that the surface lines are at least approximately vertical. Furthermore advantageously the light beam reflected by the reflecting surface has an upper light-dark boundary including an approximately horizontal section and a climbing section climbing upward from the horizontal section, and the wave sections are arranged in a part of the reflecting surface which produces the climbing section of the light-dark boundary, so that the surfaces lines extend at least approximately perpendicular to the climbing portion and the wave sections are arranged in a remaining part of the reflection surface so that the surface lines of the wave sections extend at least approximately vertical.

In another preferred embodiment the ratio of the extent of the scattering wave sections perpendicular to the surface lines of the scattering wave sections to the extent of the concentrating wave sections perpendicular to the surface lines is about 5:1 to 50:1.

In various other embodiments of the invention the light beam reflected from the reflecting surface is divergent or convergent and the scattering wave sections and the concentrating wave sections are respectively convex and concave, or concave and convex.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
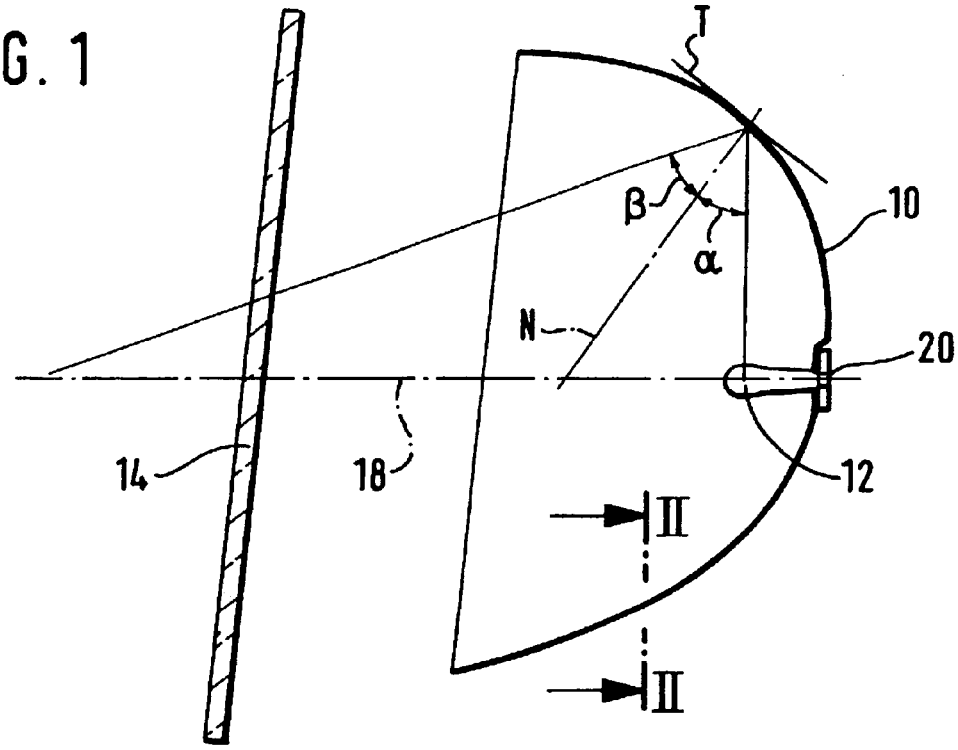
FIG. 1 is a cross-sectional view of a lighting device according to the invention.

A lighting device illustrated in FIG. 1 for a vehicle, especially a self-powered vehicle, has a reflector 10, in which a light source 12 is inserted in an opening in its peak or crown region. The lighting device can be used as a headlight, especially for low-beam, high-beam or fog light, or as a light. The light source 12 can be an incandescent bulb or a gas discharge lamp. The light outlet opening of the lighting device is covered by a light permeable disk 14, which can be smooth or can have optical elements by which the light passing through it is deflected. The reflector 10 can be made of metal or plastic material.

Figure 6:
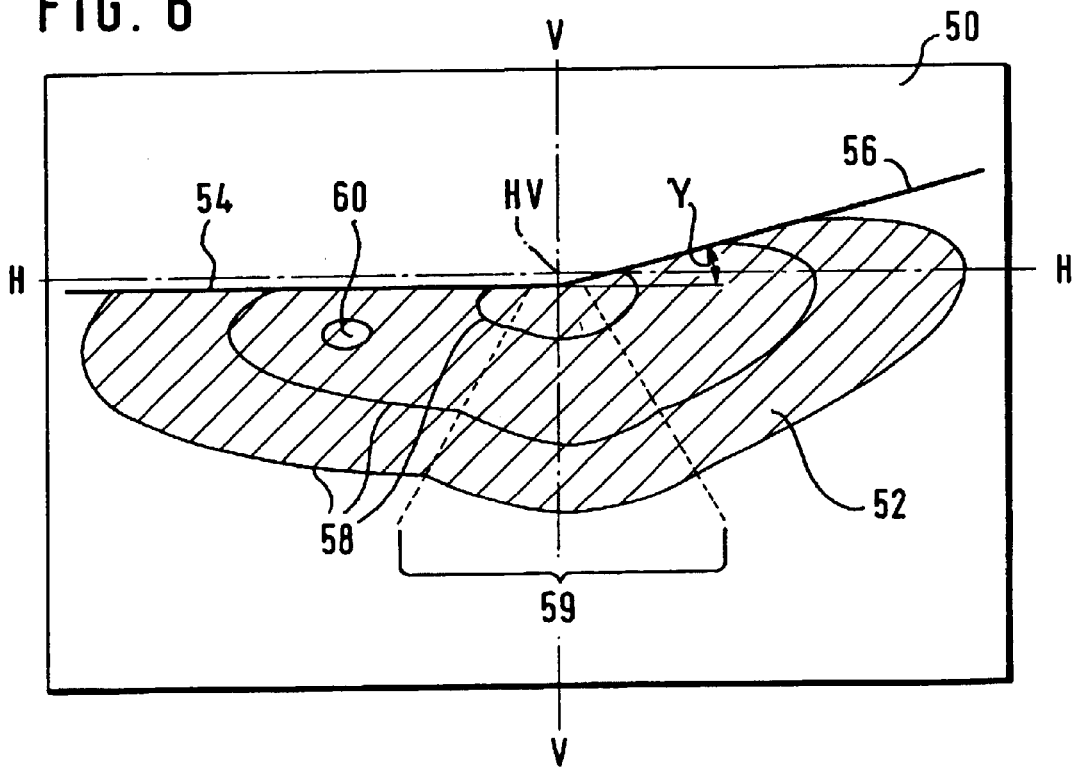
FIG. 6 is a plan view of a measurement screen placed in front of the lighting device which is illuminated by the light beam reflected from the reflector of a lighting device according to the invention.

The reflector 10 has a reflector surface 16 whose basic form is designed so that light issuing from the light source 12 is reflected as a light beam with predetermined characteristics. The characteristics of the light beam include the direction it is propagated and its scatter. As illustrated in FIG. 6, the light beam can be directed at a measuring screen 50 arranged in front of the lighting device, which has a region illuminated with the distribution of light intensities in the light beam reflected from the reflector 10. The basic shape or form of the reflecting surface 16 is determined by considering the laws of optical reflection. At the beginning of the computation of the basic shape of the reflecting surface 16, the spacing of the apex 20 of the reflector 10 on the optical axis 18 from the light emitting element of the light source 12, which means its filament or its arc, is given. Starting from the apex 20 of the peak of the reflector the basic form or shape of the reflector is computed stepwise, since the direction of the normal N for the concerned surface region of the reflector surface 16 is determined from the position of the image of the light emitting element to be reflected by it, which is superimposed on the measuring screen 50 to produce the illumination intensity distribution on it, in accordance with the geometric laws of reflection, namely that the angle of incidence $\alpha$ of the light ray issuing from the light emitting element of the light source 12 relative to the normal N of the concerned reflector surface region equals the angle of reflection $\beta$. The tangent plane T perpendicular to the computed normal N of the concerned reflector surface region can be determined from the computed normal N and its alignment therefore determined. The successive arrangement of neighboring regions of the reflector surface 16 determined one after the other produces a continuous reflector surface 16 which is advantageously continuous in second order.

For example a region 52 shown on FIG. 6 on the measuring screen 50 is illuminated by the reflected light beam from the basic shape or form of the reflection surface 16. The horizontal center plane of the measuring screen 50 is designated with HH and its vertical center plane is designed with VV. The horizontal center plane HH and the vertical center plane VV intersect each other at the point HV, through which a connecting line between the lighting device and the measuring screen 50 passes. In the illustrated embodiment the lighting device is formed as a low-beam headlight and the illuminated region 52 is bounded above by a light-dark-boundary. The light-dark boundary has a horizontal section 54, which is arranged somewhat below the horizontal center plane HH, on the on-coming traffic side, which is the left side of the measuring screen 50 in the illustrated embodiment for right-hand traffic. The light-dark boundary has a climbing section 56 extending from the horizontal section 54 to the right edge of the measuring screen 50. The angle $\gamma$ of the climbing section 56 to the light-dark boundary amounts for about 15°. The portions 54,56 of the light-dark boundary are exchanged with each other relative to the vertical plane VV in the case of an embodiment of the lighting device for left-hand traffic. Several lines 58 of equal illumination intensity are arranged in the region 52. In the prior art irregularities in the light intensity distribution are thus present in a center part 59 and in a lateral part 60 of the region 52, since the illumination intensity there is too high or too low relative to the adjacent parts and thus local maximum or minima of the light intensity result.

Figure 2:
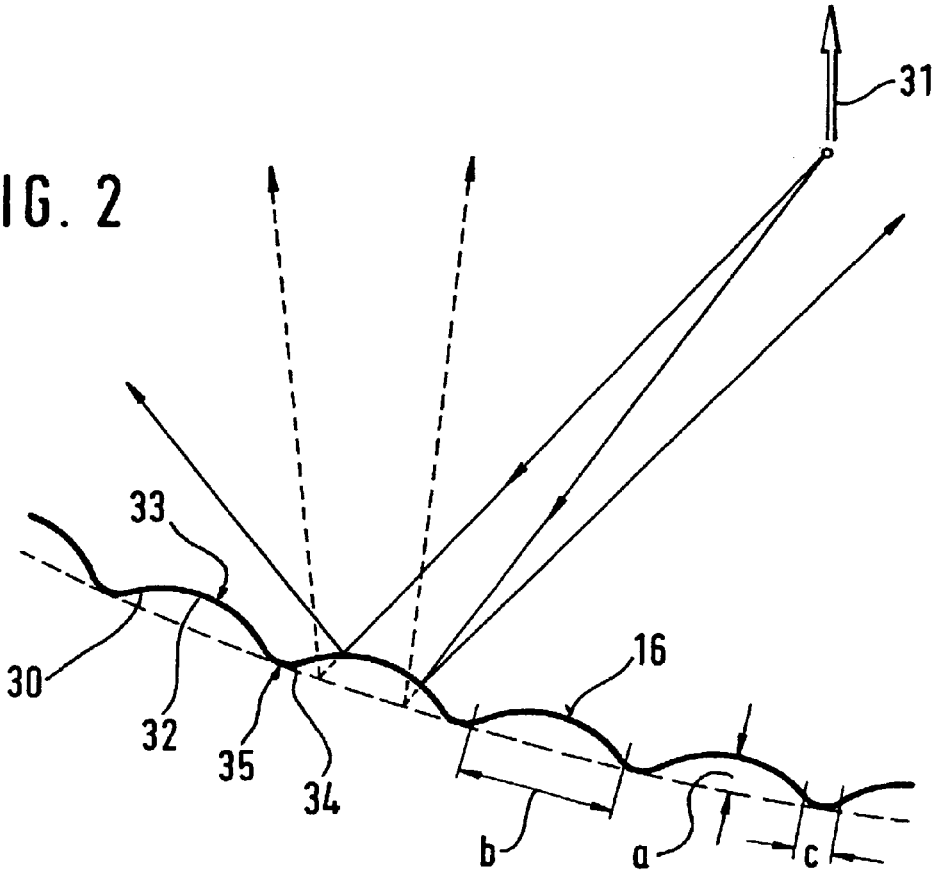
FIG. 2 is a detailed cutaway cross-sectional view of a portion of the reflector from the device of FIG. 1 taken along the section line II—II of FIG. 1 according to a first embodiment of the invention.

According to the invention a wave structure however is superimposed on the basic form or shape of the reflecting surface 16. A section line 30 results from a horizontal longitudinal section through the reflector 10. In a first embodiment shown in FIG. 2 the reflecting surface 16 of the reflector 10 is formed in the region through which the section line 30 extends so that light issuing from the light source 12 is reflected as a diverging light beam, whose light rays diverge from each other in the reflection direction 31 as shown in FIG. 2. The course of the section line of the basic form of the reflecting surface 16 is illustrated with a dashed line, while the course of the superimposed wave structure is shown with a solid line. The wave structure has alternating successive convex wave sections 32 and concave wave sections 34. The scattering of the reflected light is caused by the convex wave sections 32 convex relative to the basic shape of the reflecting surface 16 and a concentration of the reflected light is caused by the concave wave sections 34 concave relative to the basic shape of the reflecting surface 16. To eliminate the irregularities in the parts 59,60 of the region 52 according to FIG. 6, above all, a scattering of reflected light is desired since undesirable new irregularities can arise because of the concentration. It is thus provided that the convex wave sections 32 have a greater extent b perpendicular to their surface lines 33 than the extent c of the concave wave sections 34 perpendicular to their surface lines 35. The concave wave sections 34 are thus formed smaller or thinner than the corresponding convex wave sections 32 so that only a small amount of concentration of reflected light is caused by it. In FIG. 2 for example two solid lines show the path of two light rays after reflection on a convex wave section 32. The concave wave sections 34 act essentially only to combine the convex wave sections continuously with each other. Alternatively it could also be provided that the wave structure consists only of successive convex wave sections 32, whereby however the reflecting surface 16 with the superposed wave structure is no longer continuous in the second order and is thus difficult to make. The ratio of the extent b of the convex wave section 32 to the extent c of the concave wave section 34 amounts advantageously to about between 5:1 and 50:1. The convex wave sections 32 could, for example, have an amplitude a of about 0.05 mm, which is measured perpendicular to the basic form deviating or displaced from the basic form. The amplitude of the concave sections 34 is similarly reduced in comparison to the amplitude a of the convex wave sections 32 according to their substantially reduced extent c relative to the extent b of the convex wave sections 32. The extent b of the convex wave section 32 can, for example, by approximately one to a few millimeters. The extent b and/or c of the wave sections 32 and/or 34 perpendicular to their surface lines 33 and/or 35 can be constant over the entire reflecting surface 16 or can vary.

Figure 3:
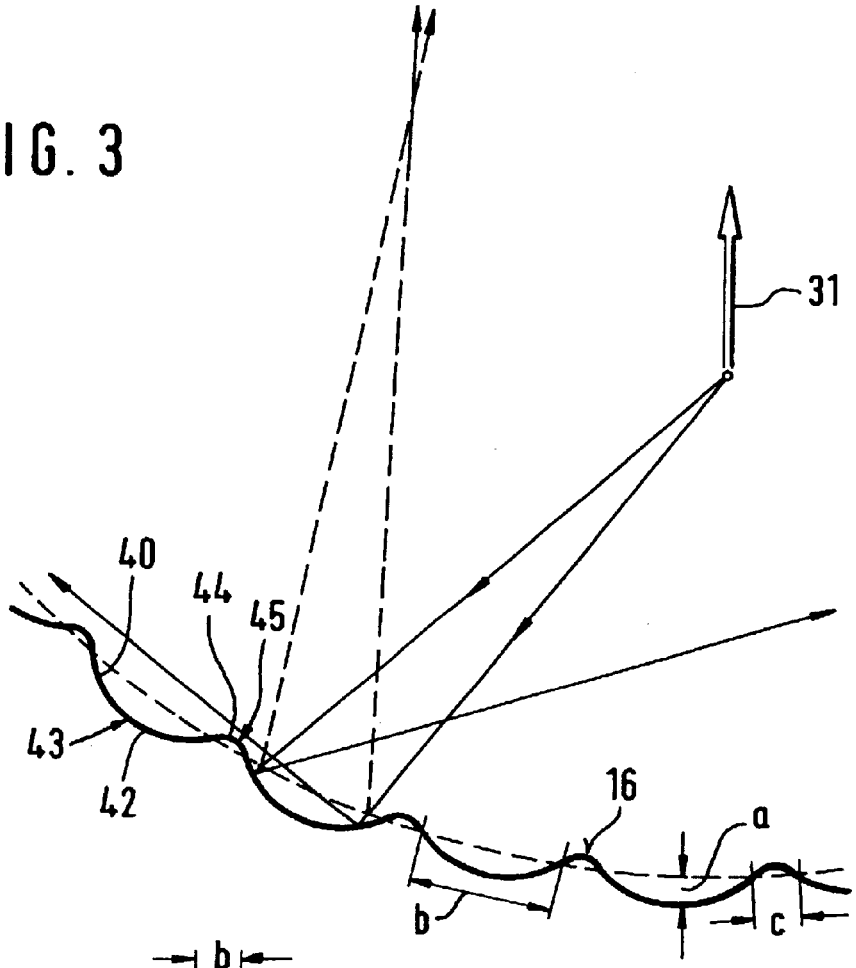
FIG. 3 is a detailed cutaway cross-sectional view of a portion of the reflector from the device of FIG. 1 taken along the section line II—II of FIG. 1 according to a second embodiment of the invention.

In FIG. 3 the section line 40 of a second embodiment resulting from a horizontal section through the reflector 10 is shown. Light issuing from the light source 12 is reflected by the region of the reflecting surface 16 through which the section line 40 extends in the light propagation or reflection direction 31 as a converging light beam, whose light rays cross, for example, as shown with the dashed lines in FIG. 3 for the illustrated two light rays. A wave structure which comprises alternating successive concave wave sections 42 and convex wave sections 44 is likewise superimposed on the basic shape or form of the reflecting surface 16 in this second embodiment. The basic form of the reflecting surface 16 is illustrated with dashed lines and the reflecting surface 16 with the superimposed wave structure is illustrated with a solid line. In this embodiment which is the reverse of the situation in the first embodiment a scattering of the reflected light is caused by the concave wave sections 42 and a concentration or convergence of the reflected light is caused by the convex wave sections 44. In FIG. 3 the paths of two light rays are shown, for example, with solid lines after reflection by a concave wave section 42. According to the invention the concave wave sections 42 perpendicular to their surface lines 43 have a greater extent b than the extent c of the convex wave sections 44 perpendicular to their surface lines 45. The convex wave sections 44 are thus smaller than the concave wave sections 42, so that only a small concentration of the reflected light is caused by them. The convex wave sections 44 serve to continuously combine the concave wave sections which each other. Alternatively of course the wave structure could comprise only successive concave wave sections, however the reflecting surface 16 would then no longer by continuous in the second order and it would be difficult to manufacture or make. The ratio of the extent b of the concave wave sections 42 to the extent c of the convex wave sections 44 advantageously amounts to from between about 5:1 to 50:1. The concave wave sections 42 could have, for example, an amplitude a, which is varying perpendicularly to the basic form or shape, of about 0.5 mm. The amplitude of the concave sections 44 is similarly reduced in comparison to the amplitude a of the convex wave sections 42 according to their substantially reduced extent c relative to the extent b of the convex wave sections 42. The extent b of the convex wave section 42 can, for example, by approximately one to a few millimeters. The extent b and/or c of the wave sections 42 and/or 44 perpendicular to their surface lines 43 and/or 45 can be constant over the entire reflecting surface 16 or can vary.

Figure 4:
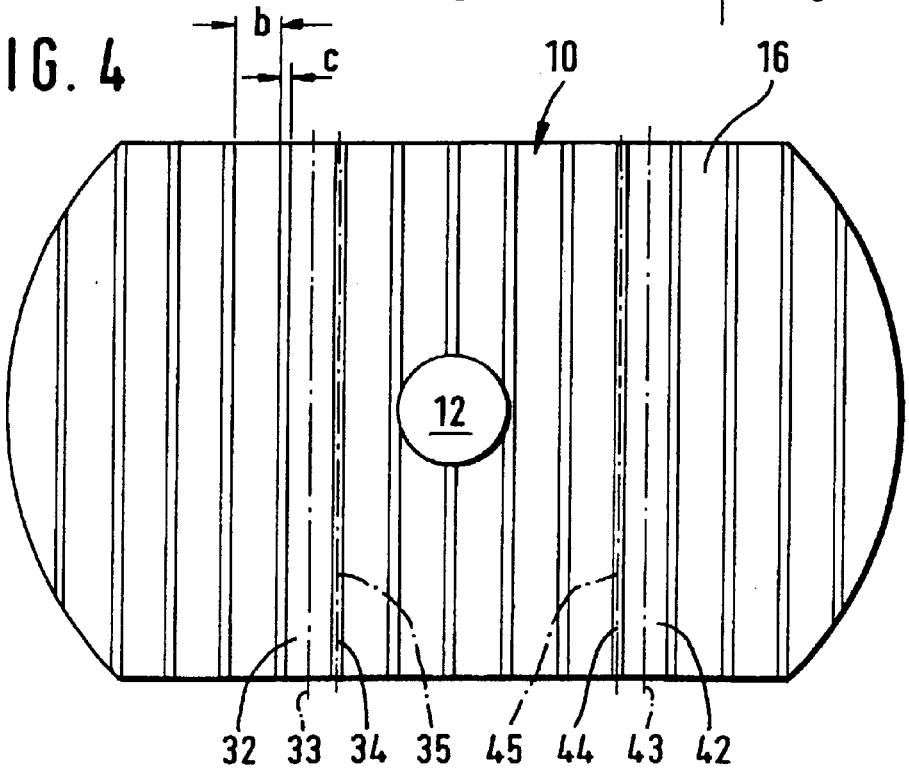
FIG. 4 is a front view of the reflector of the device shown in FIG. 1.

The reflector 10 is seen from the front in FIG. 4, which means in a direction opposite to the light reflection or propagation direction for reflected light from the reflector. The wave structure with the successive wave sections 32,34 and/or 42,44 is observable. The wave sections 32,34 and/or 42/44 are arranged in such a manner on the reflecting surface 16 that their surface lines 33,35 and/or 43,45 extend predominantly at least approximately vertical. A scattering of the reflected light substantially only in the horizontal direction is caused by this arrangement of the wave sections 32,34 and/or 42,44, so that no light is scattered out in an undesirable way over the light-dark boundary 54,56 according to FIG. 6.

Figure 5:
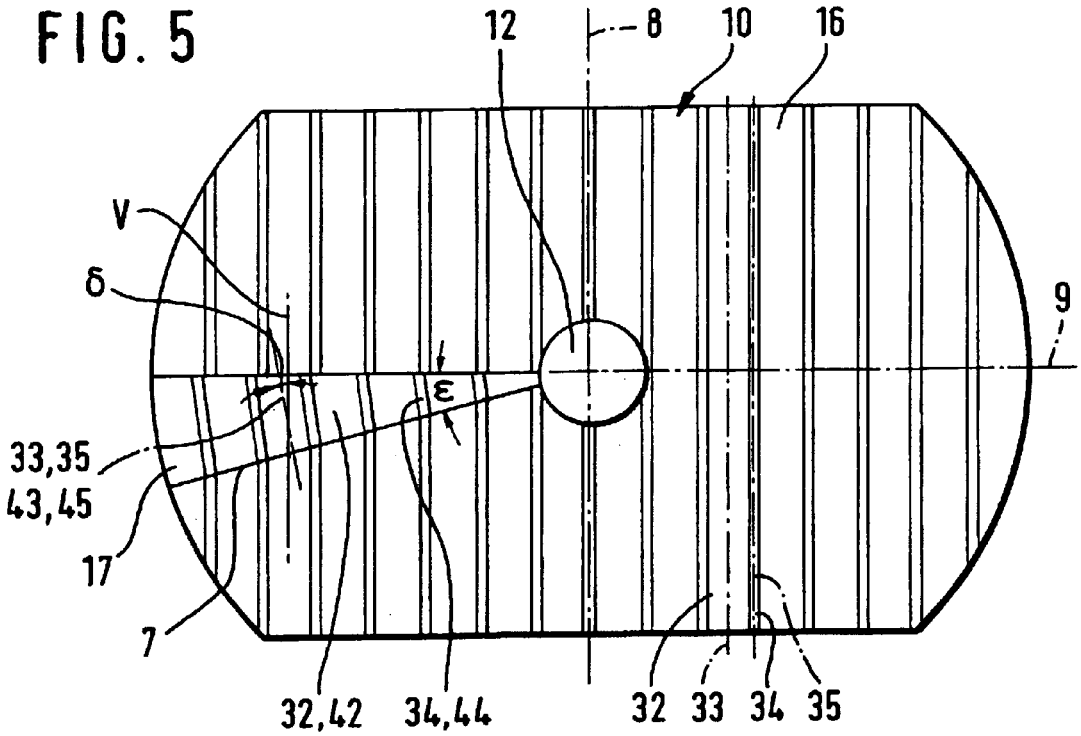
FIG. 5 is a front view of the reflector of a lighting device according to the invention in an embodiment which is modified from that of FIG. 4.

In FIG. 5 a reflector having a modified form is illustrated. In this embodiment of the reflector 10 the wave sections 32,34 and/or 42,44 are predominantly arranged on the reflecting surface in such a way that their surface lines 33,35 and/or 43,45 extend at least partially vertical. In a part 17 of the reflecting surface 16, from which light is reflected, which produces the climbing portion 56 of the light-dark boundary illustrated in FIG. 6, the wave sections 32,34 and/or 42,44 are arranged so that their surface lines 33,35 and/or 43,45 are oriented at an acute angle to the vertical. The part 17 of the reflecting surface 16 is arranged on only one side of the vertical longitudinal central plane 8 of the reflector 10 and extends upward to the horizontal central plane 9 of the reflector 10 and downward to a boundary line 7, which is inclined at an angle $\epsilon$ to the horizontal, which is at least approximately equal to the angle $\gamma$ of the climbing section 56 of the light-dark boundary relative to the horizontal. Advantageously the wave sections 32,34 and/or 42,44 are arranged in this part 17 of the reflecting surface 16 so that their surface lines 33,35 and/or 43,45 extend at least approximately perpendicular to the climbing section 56 of the light-dark boundary and thus at least approximately perpendicular to the boundary line 7. The surface lines 33,35 and/or 43,45 extend at an angle $\delta$ to the vertical V of about 15°.

By "surface line" in the above and in the following claims is meant an imaginary line (in the same sense as an axis of a disk is imaginary) extending longitudinally from one end of a wave section to another on the reflecting surface.

The disclosure in German Patent Application 196 34 755.6 of Aug. 28, 1996 is incorporated here by reference. This German Patent Application describes the invention described hereinabove and claimed in the claims appended hereininbelow and provides the basis for a claim of priority for the instant invention under 35 U.S.C. 119.

While the invention has been illustrated and described as embodied in a lighting device for a vehicle, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A lighting device for a vehicle, said light device comprising a light source (12) and a reflector (10), wherein said reflector (10) has a reflecting surface (16) with a basic shape formed so that light generated by the light source (12) is reflected from the reflecting surface (16) as a light beam and said reflecting surface is provided with a wave structure comprising a plurality of alternating successive scattering wave sections (32; 42) and concentrating wave sections (34; 44) superimposed on the basic shape of the reflecting surface, and wherein each of said scattering wave sections (32; 42) has a central line (33; 43) extending longitudinally therein on the reflecting surface and a width (b) perpendicular to said central line (33; 43) thereof, each of said concentrating wave sections (34; 44) has a central line (35; 45) extending longitudinally therein on the reflecting surface and a width (c) perpendicular to said central line thereof, and said width (b) of said scattering wave sections (32; 42) is substantially larger than said width (c) of said concentrating wave sections (34; 44), so that the light beam reflected by the reflecting surface (16) is made uniform, wherein said light beam reflected by the reflecting surface (16) has an upper light-dark boundary including an approximately horizontal section (54) and a climbing section (56) climbing upward from said horizontal section (54), the reflection surface (16) has one part (17) reflecting light which produces the climbing section (56) of the light-dark boundary, the wave sections (32, 34; 42, 44) in said one part (17) of the reflecting surface (16) are arranged, so that the central lines (33, 35; 43, 45) of the wave sections (32, 34; 42, 44) in said one part (17) of the reflecting surface (16) extend at least approximately perpendicular to the climbing section (56) of the upper light-dark boundary, and the wave sections (32, 34; 42, 44) in a remaining part of the reflecting surface (16) not including said one part (17) are arranged, so that said central lines (33, 35; 43, 45) of the wave sections (32, 34; 42, 44) in said remaining part of the reflecting surfaces (16) extend at least approximately vertical to the horizontal section (54) of the upper light-dark boundary.

2. The light device as defined in claim 1, wherein said light beam reflected by the reflecting surface (16) has an upper light-dark boundary including an approximately horizontal section (54) and a climbing section (56) climbing upward from said horizontal section (54), and the wave sections (32, 34; 42, 44) are arranged in one part (17) of the reflecting surface (16) which produces the climbing section (56) of the light-dark boundary, so that the surface lines (33, 35; 43, 45) extend at least approximately perpendicular to the climbing portion (56) of the upper light-dark boundary and the wave sections (32, 34; 42, 44) are arranged in a remaining part of the reflection surface (16) not including said one part (17), so that said surface lines (33, 35; 43, 45) of the wave sections (32, 34; 42, 44) extend at least approximately vertical.

3. The lighting device as defined in claim 1, wherein a ratio of the extent (b) of the scattering wave sections (32; 42) perpendicular to said surface lines (33, 43) of the scattering wave sections (32, 42) to the extent (C) of said concentrating wave sections (34, 44) perpendicular to said surface lines (35; 45) is about 5:1 to 50:1.

4. The light device as defined in claim 1, wherein the basic form of at least a portion of the reflecting surface (16) is shaped so that said light beam reflected from the reflecting surface (16) is divergent, the scattering wave sections (32, 42) are convex and the concentrating wave sections (34; 44) are concave.

5. The light device as defined in claim 1, wherein the basic form of at least a portion of the reflecting surface (16) is shaped so that said light beam reflected from the reflecting surface (16) is convergent, the scattering wave sections (32; 42) are concave and the concentrating wave sections (34; 44) are convex.

* * * * *